United States Patent [19]

Nash et al.

[11] Patent Number: 4,643,601

[45] Date of Patent: Feb. 17, 1987

[54] RIBBON POSITIONING MECHANISM

[75] Inventors: Dennis P. Nash, Deerfield Beach; Donald K. Rex, Highland Beach; Ludwig R. Siegl, Highland Beach; Wendy Wussow, Highland Beach, all of Fla.

[73] Assignee: International Business Machines Corporation, Armonk, N.Y.

[21] Appl. No.: 655,496

[22] Filed: Sep. 28, 1984

[51] Int. Cl.[4] ..... B41J 35/14

[52] U.S. Cl. ..... 400/216.1; 400/196.1; 400/208; 400/212; 400/240.4; 400/248

[58] Field of Search ..... 400/194, 195, 196, 196.1, 400/207, 208, 208.1, 211, 212, 214, 216.1, 216.3, 216.5, 217, 217.1, 234, 235, 235.1, 240, 240.4, 248, 248.1, 248.2, 248.3, 697.1, 323

[56] References Cited

U.S. PATENT DOCUMENTS

| | | | |
|---|---|---|---|
| 1,724,698 | 8/1929 | Doverspike | 400/248.1 X |
| 3,304,859 | 2/1967 | Schenk | 101/102 |
| 3,451,520 | 6/1969 | Greer et al. | 400/216.1 |
| 3,891,078 | 6/1975 | Jung | 400/158.1 |
| 3,904,017 | 9/1975 | Frechette | 400/214 X |
| 3,970,183 | 7/1976 | Robinson et al. | 400/323 X |
| 4,088,218 | 5/1978 | Depew | 400/208 |
| 4,203,676 | 5/1980 | Hatsell | 400/248 X |
| 4,203,677 | 5/1980 | Hatsell | 400/214 |
| 4,236,839 | 12/1980 | Mueller | 400/216.2 X |
| 4,280,767 | 7/1981 | Heath | 400/216.3 X |
| 4,284,364 | 8/1981 | Rello | 400/234 |
| 4,329,072 | 5/1982 | Kacmarcik | 400/208 |
| 4,383,775 | 5/1983 | Trammell et al. | 400/248 X |
| 4,402,622 | 9/1983 | Sugiura | 400/212 |
| 4,407,595 | 10/1983 | Gershnow | 400/212 |
| 4,425,046 | 1/1984 | Van Horne et al. | 400/208 |
| 4,472,073 | 9/1984 | Valle et al. | 400/214 X |
| 4,511,270 | 4/1985 | Bohmer | 400/697.1 X |

FOREIGN PATENT DOCUMENTS

| | | | |
|---|---|---|---|
| 0023424 | 2/1981 | European Pat. Off. | 400/208 |
| 0023806 | 2/1981 | European Pat. Off. | 400/208 |
| 0055614 | 7/1982 | European Pat. Off. . | |
| 2508258 | 12/1982 | France | 400/240.4 |
| 0016881 | 1/1983 | Japan | 400/212 |
| 0084788 | 5/1983 | Japan | 400/216.1 |

OTHER PUBLICATIONS

IBM Technical Disclosure Bulletin, "High-Speed Ribbon Mechanism with Ribbon Lift Control", G. S. Aldrich, vol. 23, No. 10, Mar. 1981, pp. 4555–4556.

IBM Technical Disclosure Bulletin, "Misalignment Correction for Ribbon Lift Mechanism", Burchett et al, vol. 26, No. 3A, Aug. 1983, pp. 1159–1160.

*Primary Examiner*—Ernest T. Wright, Jr.

*Attorney, Agent, or Firm*—Jeffrey S. LaBaw; J. L. Abzug; R. E. Bee

[57] ABSTRACT

A ribbon positioning mechanism comprises a ribbon cartridge, a nosepiece, a stepper motor and flexible ribbon guides connecting the ribbon cartridge to the nosepiece. The nosepiece has two side members connected by a bridge, one of which has a downwardly extending leg. A rack located on the bottom of the leg engages a pinion attached to the stepper motor for lifting the nosepiece into a desired position. A ribbon, having a plurality of parallel color bands, passes from the ribbon cartridge via the flexible ribbon guides and through the nosepiece where it is aligned with a print head. The nosepiece freely slides on vertical guide posts attached to a print head carrier and printer logic controls the stepper motor to align the desired color band with the print head.

22 Claims, 6 Drawing Figures

RIBBON POSITIONING MECHANISM

BACKGROUND OF THE INVENTION

1. Technical Field

This invention relates to a mechanism for positioning a ribbon in a printing machine.

2. Background Art

In most types of printing machines, ribbon shifting, either to change colors or to make corrections, is accomplished by one of two methods. In the first method, illustrated in U.S. Pat. No. 3,451,520, issued on June 24, 1969, to the assignee of this invention, the ribbon is supported in a guide, such as a bail arm, which is mechanically arranged to align the desired band on the ribbon with a printing element in a printing station. Although this method is satisfactory when only two colors are employed, excessive vertical movement of a multi-colored ribbon within the guide can cause snagging and dragging. Furthermore, this method is not particularly suited for high-speed printing in which it may be desirable to change print colors every character, or even every column in a matrix-formed character.

In the second method, illustrated in U.S. Pat. No. 4,329,072, issued May 11, 1982, to the assignee of this invention, a ribbon cartridge is supported on a pivotable plate which is rotated by a stepper motor to align different color bands with the print element. While this method has overcome some of the drawbacks present in the first method, it is still not conducive to rapid color changes, especially when printing in more than two colors is desired. When the entire ribbon cartridge and its supporting plate has to be rotated to effect a color change, it is practically impossible to change colors within a character, or every character, without slowing the printing speed to an unacceptable level.

DISCLOSURE OF THE INVENTION

It is the principal object of this invention to provide an improved mechanism for aligning different bands of a ribbon with a print head in a printing machine.

It is a related object to provide a multi-color ribbon shifting mechanism for moving the ribbon rapidly and smoothly to align any one of a plurality of parallel color bands with the print head.

In accordance with these objects, a ribbon positioning mechanism comprises a ribbon cartridge, a nosepiece, a stepper motor and flexible ribbon guides connecting the ribbon cartridge to the nosepiece. The nosepiece has two side members connected by a bridge, one of which has a downwardly extending leg. A rack located on the bottom of the leg engages a pinion attached to the stepper motor for lifting the nosepiece into a desired position. A ribbon, having a plurality of parallel color bands, passes from the ribbon cartridge via the flexible ribbon guides and through the nosepiece where it is aligned with a print head. The nosepiece freely slides on vertical guide posts attached to a print head carrier and printer logic controls the stepper motor to align the desired color band with the print head. In the preferred embodiment, the nosepiece has a stop member located on the bottom of the bridge dimensioned such that the nosepiece will bottom out on the print head with the center line of the uppermost print band being exactly motor step below the print head center line. This provides a fixed and known reference position for the nosepiece which allows for convenient, periodic reconfirmation of the positioning control.

BRIEF DESCRIPTION OF THE DRAWINGS

The foregoing and other advantages of the invention will be more fully understood with reference to the description of the preferred embodiment and with reference to the drawings wherein.

DESCRIPTION OF THE PREFERRED EMBODIMENT

Figure 1:
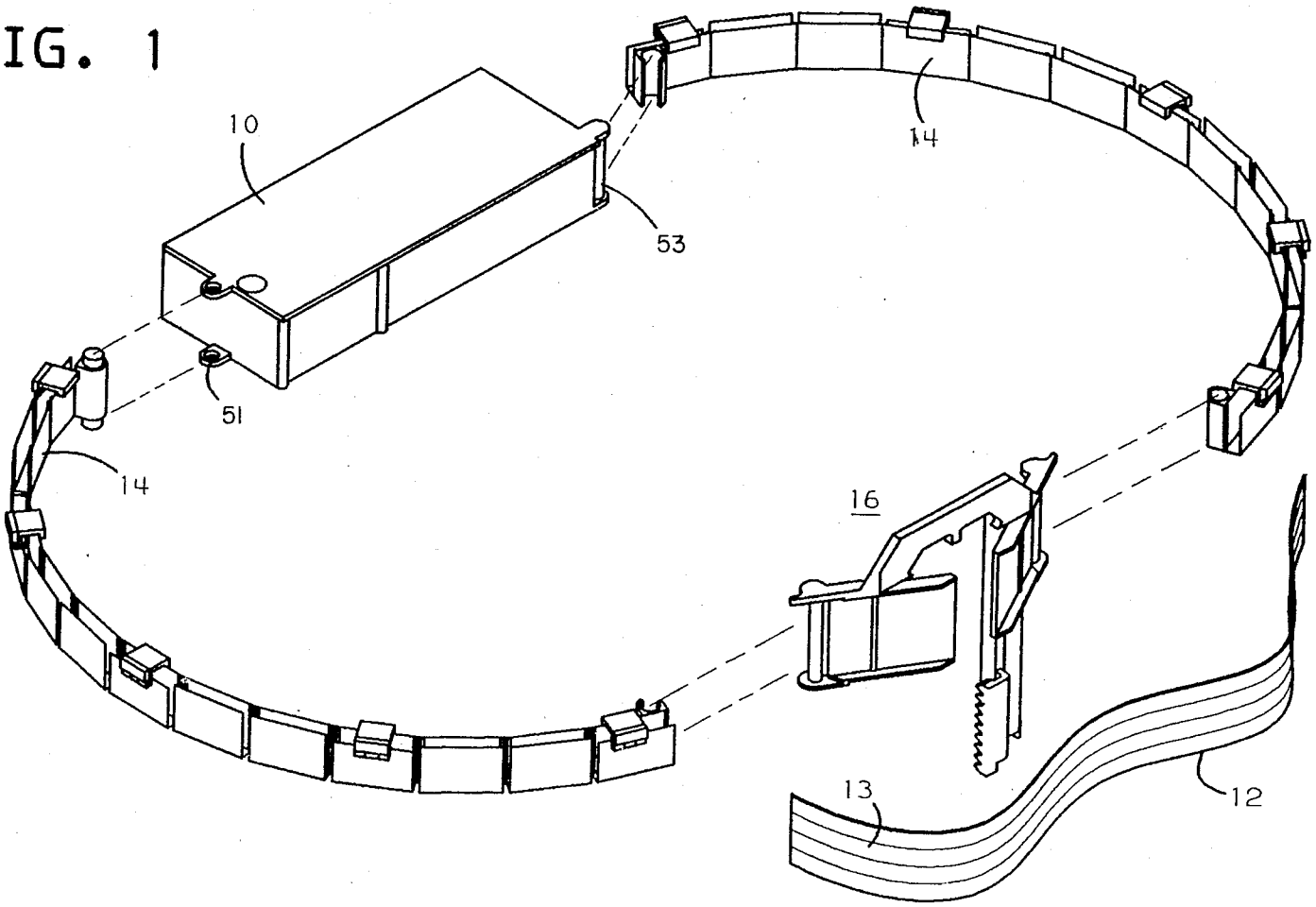
FIG. 1 is an exploded view of the ribbon positioning mechanism without stepper motor.

Referring to FIG. 1, the ribbon positioning mechanism includes a ribbon cartridge 10 for containing a supply of ribbon 12. Ribbon 12 has four parallel color bands 13. Flexible ribbon guides 14, which are U-shaped channels, snap on to the ends 51 and 53 of ribbon cartridge 10 and guide the ribbon 12 to nosepiece 16. The flexible ribbon guides 14 are described more fully in commonly assigned, co-pending application by Dennis Nash entitled "Flexible Leader", Ser. No. 656,816 filed Oct. 1, 1984. Nosepiece 16 holds ribbon 12 in printing position and aligns the desired color band 13 with a print head 48 (not shown in FIG. 1) which may be any type including, but not limited to, a matrix print head, daisy wheel or ball-type print head. In use, the ribbon cartridge 10 is mounted in a stationary manner on the main frame of a printer and the nosepiece 16 is mounted on a print head carrier and moved back and forth with the print head 48 as it moves across the page being printed. The structure of the mainframe of the printer and print head carrier is substantially similar to that described in U.S. Pat. No. 3,970,183, particularly FIG. 1.

Figure 2:
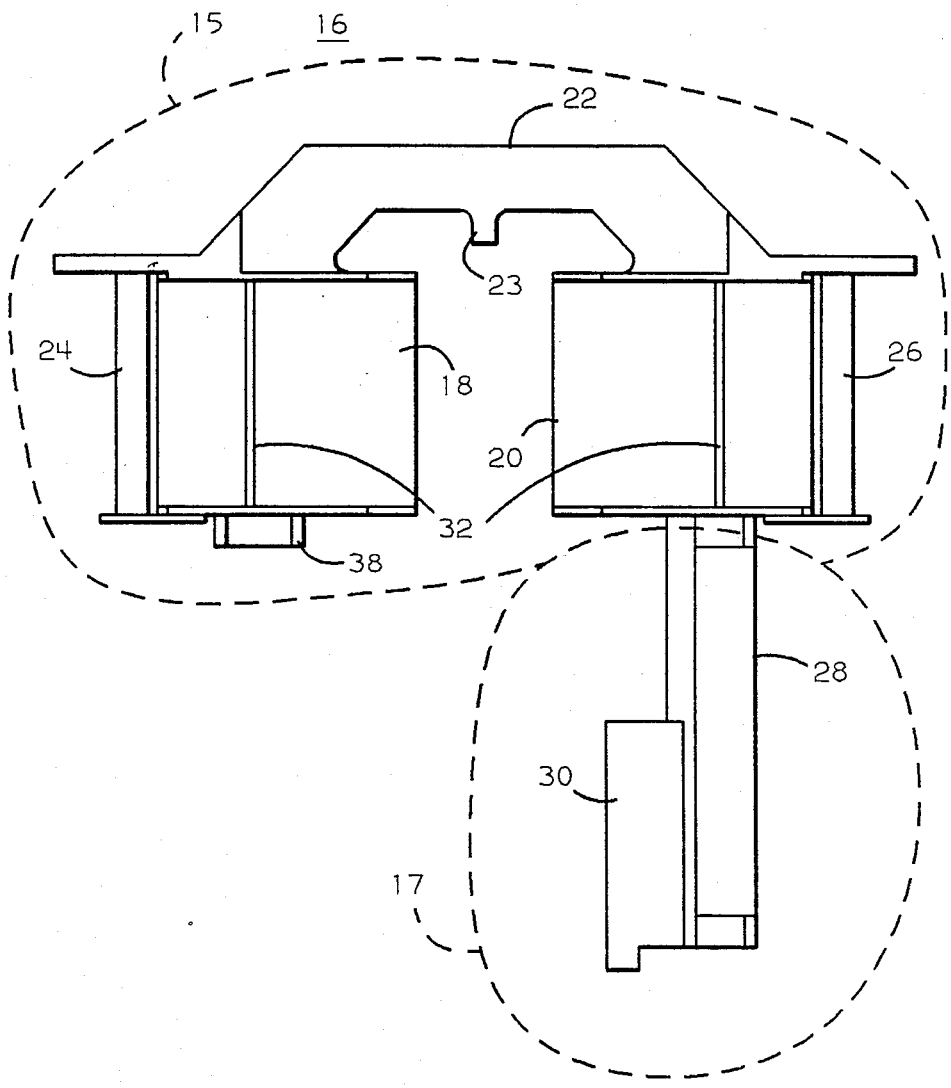
FIG. 2 is an enlarged front view of the nosepiece.
Figure 3:
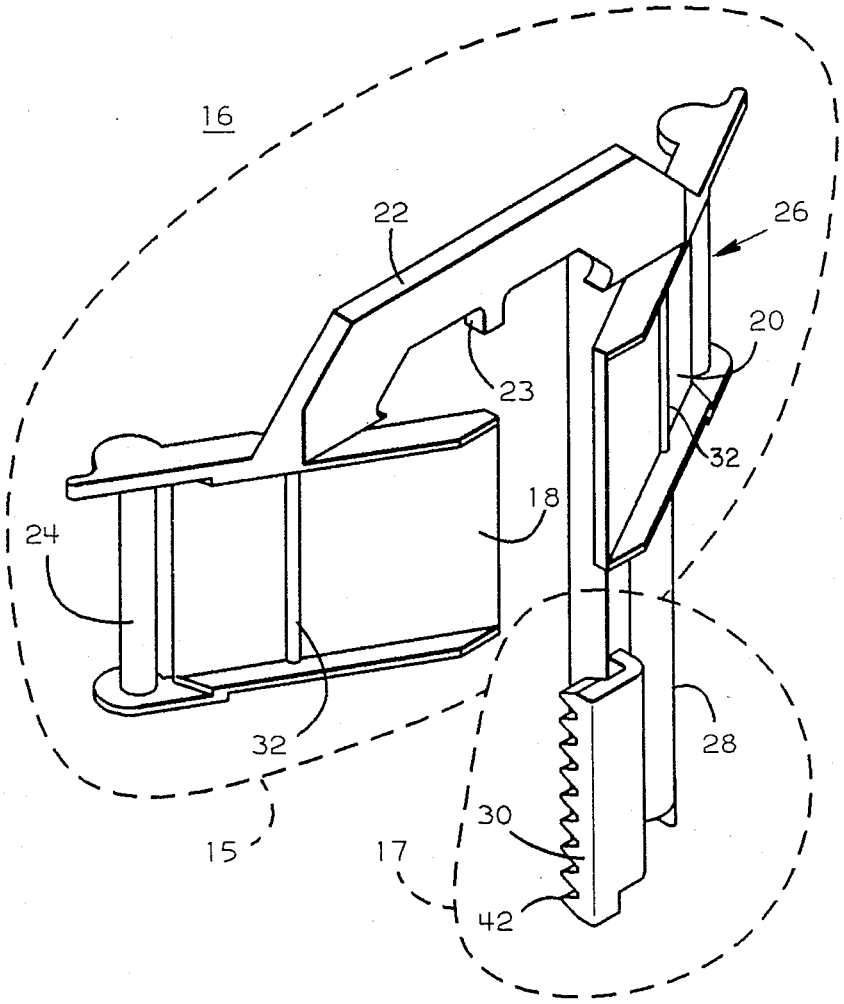
FIG. 3 is a perspective view of the front of the nosepiece.

Referring to FIGS. 2 and 3, the nosepiece 16, includes an upper section 15 and a lower section 17. The upper section 15 includes two side members 18 and 20 joined at their respective tops by connecting bridge 22. Connecting bridge 22 includes a stop member 23 on its underside. The utility of stop member 23 will be more fully discussed in conjunction with the discussion of positioning and control of the nosepiece 16.

Adjacent side members 18 and 20, at the ends opposite the connecting bridge 22, are vertical mounting bars 24 and 26, respectively. Flexible ribbon guides 14 snap lock onto vertical mounting bars 24 and 26, thereby completing a loop in which ribbon 12 can circulate through the printer.

Side members 18,20 also include raised, vertical ridges 32. Raised, vertical ridges 32 prevent the ribbon 12 from contacting the entire surface of the side members 18,20, thereby reducing frictional forces as the ribbon 12 circulates through the nosepiece 16.

Figure 4:
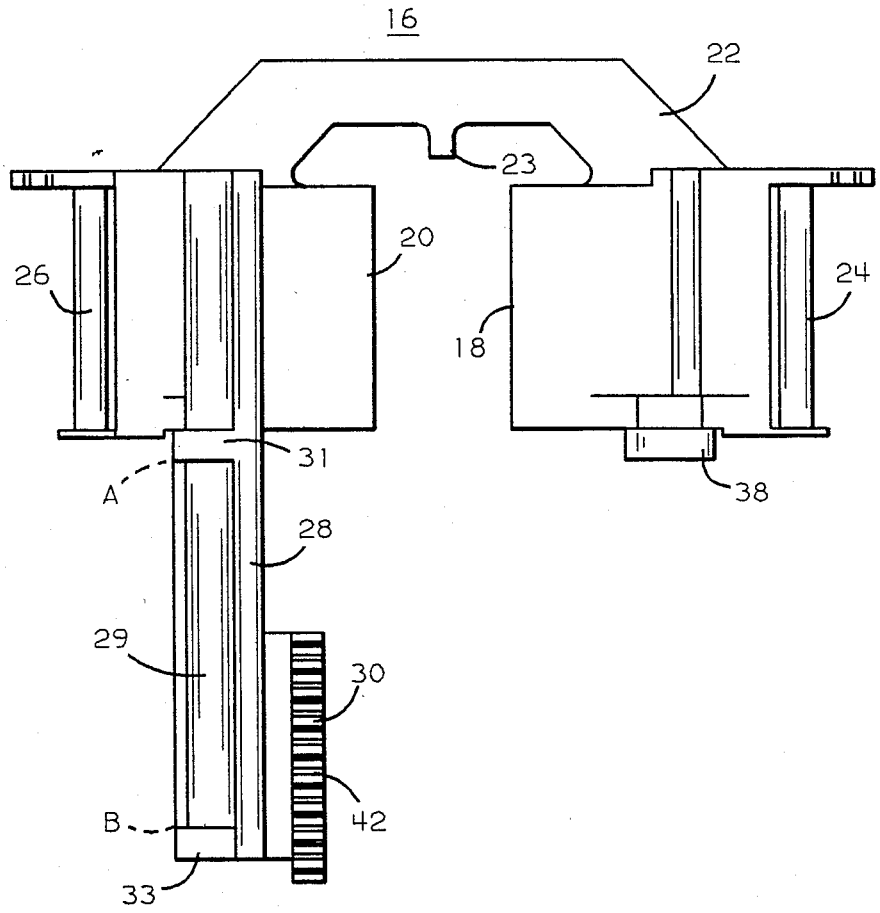
FIG. 4 is a rear view of the nosepiece.

The lower section 17 includes leg 28 extending downwardly from side member 20. As seen in FIG. 4, leg 28 has the shape of a hollow tube with a longitudinal cutout 29 in the rear extending from point A to point B. Guide rings 31 and 33 located above point A and below point B, respectively, provide bearing surfaces at the middle and bottom of the nosepiece 16, and together with leg 28, define a bore 35 shown in FIG. 6.

Figure 6:
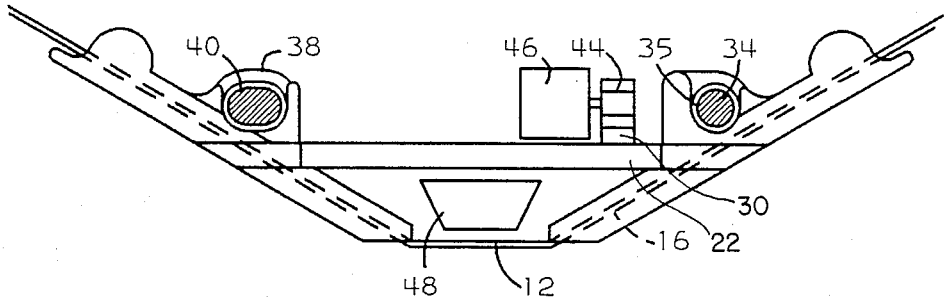
FIG. 6 is a top view of the nosepiece.

Referring back to FIGS. 2 and 4, attached to the bottom of the other side member 18 is a guide ring 38. During assembly of the printer, nosepiece 16 is supported and aligned with the print head 48 on the print head carrier by vertical guide posts 34 and 40, as illustrated in FIG. 6. Guide post 34 passes through the bore 35 and guide post 40 passes through guide ring 38. While guide posts 34 and 40 constrain movement of the nosepiece 16 in the horizontal direction, the nosepiece 16 is free to slide along guide posts 34 and 40 in the vertical direction.

Figure 5:
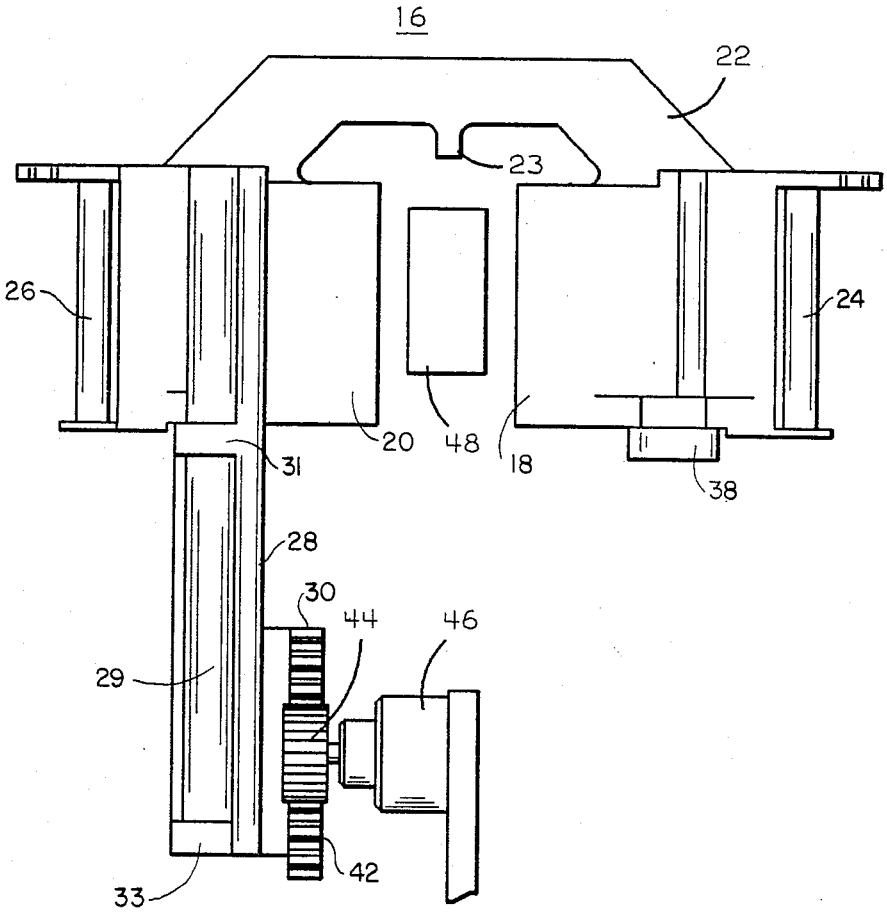
FIG. 5 is a rear view of the nosepiece with stepper motor and pinion engaged.

Referring to FIGS. 3 and 4, also included in the lower section 17 is a rack 30 having teeth 42 adjacent to the bottom of leg 28. In the preferred embodiment, the rack 30 is fabricated with nine teeth 42 to engage and mesh with a pinion 44 attached to a stepper motor 46 as seen in FIG. 5. Stepping of the stepper motor 46 causes the rack 30, and the nosepiece 16 as a whole, to move upward or downward, depending on the direction of rotation of the stepper motor 46. The pinion 44 and rack 30 are designed so that eight steps of the stepper motor 46 will move the nosepiece 16 the proper distance to change from one color band 13 to the next color band 13 on the ribbon 12.

Stop member 23 on connecting bridge 22 is designed so that the nosepiece 16 will bottom out on the print head 48 with the center line of the upper color band 13 exactly one motor step below the center line of the print head 48. Bottoming out occurs when stop member 23 comes into contact with the top of the print head 48. After such bottoming out, one upward step is required to place the uppermost color band 13 in its proper position for printing.

This bottomed out position provides a fixed and known reference position for the nosepiece 16. The nosepiece 16 is raised or lowered to the proper position for the desired one of color bands 13 by stepping the stepper motor 46 the proper number of steps in the proper direction of rotation. The nosepiece 16 is periodically returned to the bottomed out position to recalibrate and reconfirm the positioning control. The control of stepper motor 46 by the printer logic is beyond the scope of this invention and is well-known by those skilled in the stepper motor art.

As described above and shown in the figure, the invention is carefully designed to prevent the buildup of tolerances which would doom efforts to accurately align the color bands 13 to the center line of the print head 48. In the prefered embodiment, the upper and lower sections 15, 17 of the nosepiece 16 are a single unit. It is readily understood by those skilled in the art that any method of rigidly attaching two discrete sections would not depart from the scope and spirit of this invention. A nosepiece which had pivotally attached sections, for example, would have considerably more play and cause tolerance buildup to an intolerable level.

The motion imparted by the rack 30 and pinion 44 is a straight line, vertical motion. This keeps the ribbon 12 parallel to the print head 48 and the page being printed.

When switching between two colors on a bi-color ribbon, much less attention need be lavished on tolerance reduction. However, when four colors are used in a relatively narrow ribbon tolerance build-up becomes critical.

While the invention has been particularly shown and described with reference to a preferred embodiment thereof, it will be understood by those skilled in the art that various changes in detail may be made therein without department from the spirit, scope and teaching of the invention. Accordingly, the apparatus herein disclosed is to be considered merely as illustrative, and the invention is to be limited only as specified in the claims.

We claim:

1. In a printing machine including a print head and a ribbon having a plurality of parallel color bands, a nosepiece detachable from said printing machine for positioning and guiding said ribbon comprising:

an upper section having two side members and a connecting bridge intermediate said side members and connected thereto: and a lower section rigidly attached to said upper section including at least one leg downwardly extending from said upper section and transfer means, attached to said leg, for transferring straight-line, vertical motion to said nosepiece.

2. The nosepiece according to claim 1 wherein said leg extends from one of said side members.

3. The nosepiece according to claims 1 or 2 further including guide means for aligning said nosepiece with said print head.

4. The nosepiece according to claims 1 or 2 wherein said transfer means is a rack.

5. The nosepiece according to claims 1 or 2 wherein said connecting bridge includes a stop member for providing a reference position relative to said print head.

6. The nosepiece according to claims 1 or 2 wherein at least one of said side members includes at least one raised, vertical ridge for reducing friction between said ribbon and said side members.

7. Apparatus for positioning and aligning a ribbon having a plurality of parallel color bands with a print head in a printing machine comprising:

motor means;

a ribbon cartridge for containing a supply of ribbon;

a nosepiece detachable from said printing machine for guiding said ribbon into printing position;

said nosepiece including an upper section having two said members and a connecting bridge, and a lower section rigidly attached to said upper section having at least one leg downwardly extending from said upper section, said leg including transfer means engaged with said motor means for transferring straight-line vertical motion from said motor means to said nosepiece; and means for guiding said ribbon cartridge and said nosepiece;

whereby operation of said motor means moves said nosepiece and said ribbon into alignment with said print head.

8. The apparatus according to claim 7 wherein said leg extends from one of said side members.

9. The apparatus according to claim 8 wherein said ribbon includes a plurality of parallel color bands whereby operation of said motor means aligns a desired one of said color bands with said print head.

10. The apparatus according to claim 8 wherein said motor means is a stepper motor.

11. The apparatus according to claim 8 wherein said nosepiece further includes guide means for aligning said nosepiece with said print head.

12. The apparatus according to claim 8 wherein said connecting bridge of said nosepiece includes a stop member for providing a reference position relative to said print head.

13. The apparatus according to claim 8 wherein said transfer means is a rack.

14. The apparatus according to claim 13 wherein said motor means includes a pinion engaged with said rack whereby operation of said motor means moves said nosepiece and said ribbon to align said ribbon with said print head.

15. Apparatus for positioning and aligning a ribbon having a plurality of parallel color bands, with a print head in a printing machine comprising:

motor means; and a nosepiece detachable from said printing machine for guiding said ribbon into printing position;

said nosepiece including an upper section having two side members and a connecting bridge, and a lower section rigidly attached to said upper section having at least one leg downwardly extending from said upper section, said leg including transfer means non-pivotally engaged with said motor means for transferring straight-line vertical motion from said motor means to said nosepiece;

whereby operation of said motor means moves said nosepiece and said ribbon into alignment with said print head.

16. The apparatus according to claim 15 wherein said leg extends from one of said side members.

17. The apparatus according to claim 16 wherein said ribbon includes a plurality of parallel color bands whereby operation of said motor means aligns a desired one of said color bands with said print head.

18. The apparatus according to claim 16 wherein said motor means is a stepper motor.

19. The apparatus according to claim 16 wherein said nosepiece further includes guide means for aligning said nosepiece with said print head.

20. The apparatus according to claim 16 wherein said connecting bridge of said nosepiece includes a stop member for providing a reference position relative to said print head.

21. The apparatus according to claim 16 wherein said transfer means is a rack.

22. The apparatus according to claim 21 wherein said motor means includes a pinion engaged with said rack whereby operation of said motor means moves said nosepiece and said ribbon to align said ribbon with said print head.

* * * * *